US009243643B2

(12) United States Patent
Beers et al.

(10) Patent No.: US 9,243,643 B2
(45) Date of Patent: Jan. 26, 2016

(54) CABIN AIR COMPRESSOR HOUSING

(75) Inventors: Craig M. Beers, Wethersfield, CT (US); Seth E. Rosen, Middletown, CT (US)

(73) Assignee: HAMILTON SUNDSTRAND CORPORATION, Windsor Locks, CT (US)

( * ) Notice: Subject to any disclaimer, the term of this patent is extended or adjusted under 35 U.S.C. 154(b) by 701 days.

(21) Appl. No.: 13/559,906

(22) Filed: Jul. 27, 2012

(65) Prior Publication Data

US 2014/0030070 A1 Jan. 30, 2014

(51) Int. Cl.

| | |
|---|---|
| ***F04D 25/08*** | (2006.01) |
| ***F04D 29/057*** | (2006.01) |
| ***F04D 29/42*** | (2006.01) |
| ***F04D 29/58*** | (2006.01) |

(52) U.S. Cl.

CPC ..... *F04D 25/082* (2013.01); *F04D 29/057* (2013.01); *F04D 29/4206* (2013.01); *F04D 29/584* (2013.01); *F04D 29/5806* (2013.01); *Y10T 29/49245* (2015.01)

(58) Field of Classification Search

CPC ... F04D 25/082; F04D 29/046; F04D 29/056; F04D 29/057; F04D 29/0473; F04D 29/58; F04D 29/582; F04D 29/5806; F04D 29/4206; F04D 29/4283; F04D 29/60; F04D 29/601; F04D 29/624; F04D 17/10; F05B 2230/60; Y10T 29/49245

See application file for complete search history.

(56) References Cited

U.S. PATENT DOCUMENTS

| | | | | |
|---|---|---|---|---|
| 6,401,473 | B1 | 6/2002 | Ng et al. | |
| 7,302,804 | B2 | 12/2007 | Murry et al. | |
| 7,322,202 | B2 | 1/2008 | Zywiak et al. | |
| 7,342,332 | B2 * | 3/2008 | McAuliffe et al. | 310/58 |
| 7,394,175 | B2 | 7/2008 | McAuliffe et al. | |
| 8,882,454 | B2 * | 11/2014 | Chrabascz et al. | 415/180 |
| 2004/0005228 | A1 | 1/2004 | Agrawal et al. | |
| 2012/0011878 | A1 | 1/2012 | Hipsky | |

OTHER PUBLICATIONS

China Patent Application No. 201310414724.6 First Office Action dated May 29, 2015, 10 pages.

* cited by examiner

*Primary Examiner* — Craig Kim
*Assistant Examiner* — Brian P Wolcott
(74) *Attorney, Agent, or Firm* — Cantor Colburn LLP

(57) ABSTRACT

A cabin air compressor housing for a cabin air compressor assembly includes a compressor volute configured to direct a compressed flow to a compressor outlet. The cabin air compressor housing also includes a journal bearing support having a journal bearing bore. The cabin air compressor housing further includes an interior portion between the compressor volute and the journal bearing support. The interior portion includes a plurality of cooling airflow holes having a ratio of a diameter of the journal bearing bore to a diameter of one of the cooling airflow holes between 3.64 and 4.52.

14 Claims, 4 Drawing Sheets

CABIN AIR COMPRESSOR HOUSING

BACKGROUND OF THE INVENTION

The subject matter disclosed herein relates to aircraft environmental control. More specifically, the subject disclosure relates to a compressor housing of a cabin air compressor for an aircraft environmental control system.

Environmental control systems (ECSs) are utilized on various types of aircraft for several purposes, such as in cooling systems for the aircraft. For example, components of an ECS may be utilized to remove heat from various aircraft lubrication and electrical systems and/or used to condition aircraft cabin air. A cabin air conditioner includes one or more cabin air compressors (CACs) which compress air entering the system, from an outside source or from a ram air system. The compressed air is delivered to an environmental control system to bring it to a desired temperature and delivered to the aircraft cabin. After passing through the cabin, the air is typically exhausted to the outside. CACs are typically driven by air-cooled electric motors, which are cooled by a flow of cooling air typically drawn by the ram air system. Cooling air from the ram air system may also be used to cool bearings in the CACs.

BRIEF DESCRIPTION OF THE INVENTION

According to one aspect, a cabin air compressor housing includes a compressor volute configured to direct a compressed flow to a compressor outlet. The cabin air compressor housing also includes a journal bearing support having a journal bearing bore. The cabin air compressor housing further includes an interior portion between the compressor volute and the journal bearing support. The interior portion includes a plurality of cooling airflow holes having a ratio of a diameter of the journal bearing bore to a diameter of one of the cooling airflow holes between 3.64 and 4.52.

According to one aspect, a cabin air compressor assembly includes a compressor rotor operably connected to a shaft, and a plurality of bearings to support rotation of the shaft. The cabin air compressor assembly also includes a cabin air compressor housing. The cabin air compressor housing includes a compressor volute configured to direct a compressed flow produced by the compressor rotor to a compressor outlet. The cabin air compressor housing also includes a journal bearing support having a journal bearing bore and configured to receive one of the bearings. The cabin air compressor housing further includes an interior portion between the compressor volute and the journal bearing support. The interior portion includes a plurality of cooling airflow holes having a ratio of a diameter of the journal bearing bore to a diameter of one of the cooling airflow holes between 3.64 and 4.52.

According to another aspect of the invention, a method of assembling a cabin air compressor assembly includes receiving a journal bearing in a journal bearing bore of a journal bearing support of a cabin air compressor housing. A compressor rotor seal is coupled to the cabin air compressor housing. A compressor rotor supported by the journal bearing is positioned proximate an interior portion of the cabin air compressor housing to form a mixing chamber. The mixing chamber is configured to receive a bearing cooling flow through the journal bearing bore and a portion of air flow that leaks past the compressor rotor seal. The interior portion of the cabin air compressor housing includes a plurality of cooling airflow holes to establish a cooling outlet flow. The cabin air compressor housing has a ratio of a diameter of the journal bearing bore to a diameter of one of the cooling airflow holes between 3.64 and 4.52.

DETAILED DESCRIPTION OF THE INVENTION

Figure 1:
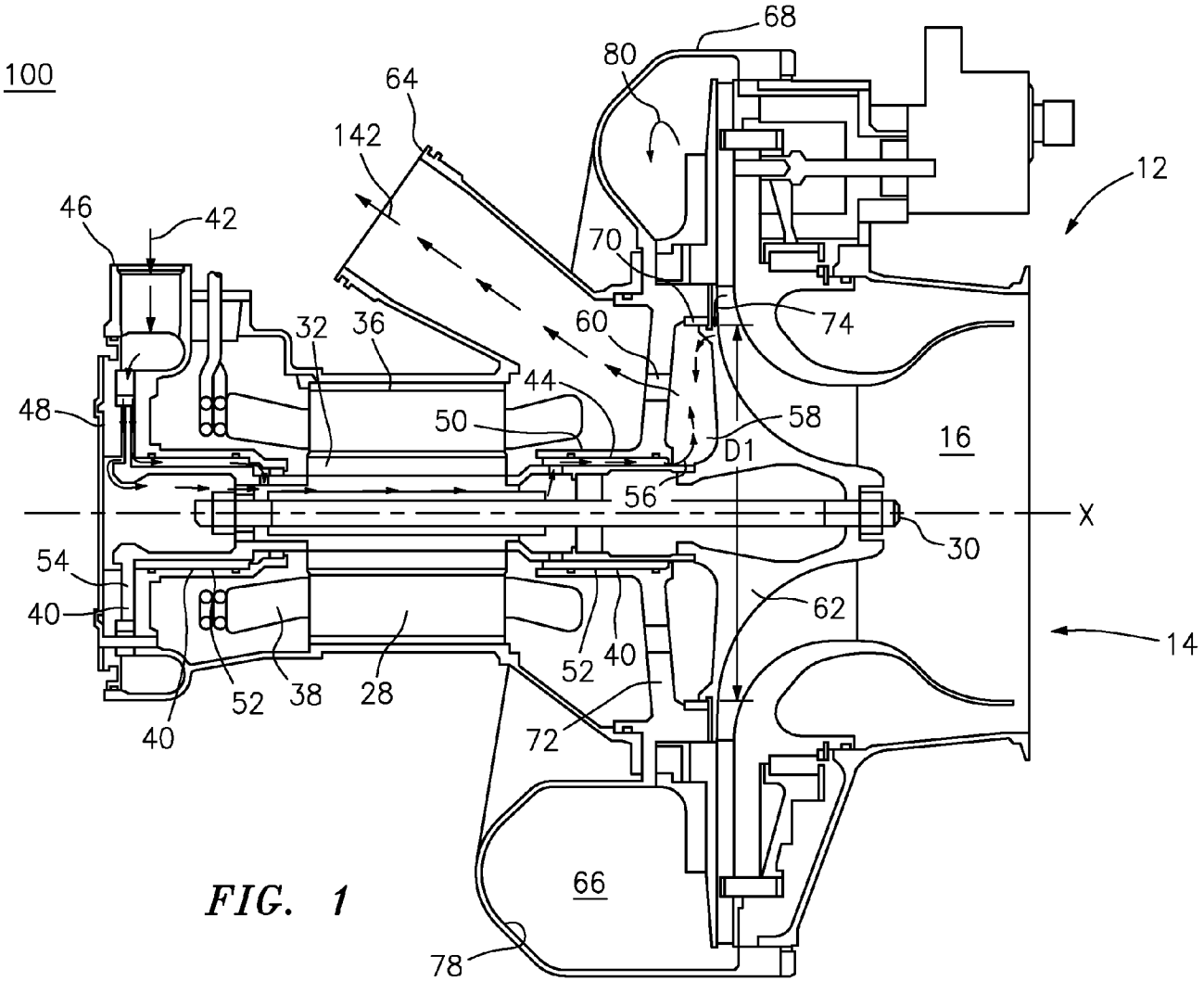
FIG. 1 is a partial cross-sectional view of a cabin air compressor assembly.

Shown in FIG. 1 is a cross-sectional view of a cabin air compressor (CAC) assembly 12, one or more of which may be used in an environmental control system 100 for an aircraft. The CAC assembly 12 compresses air flow 14 received at a compressor inlet 16. The CAC assembly 12 is driven by a CAC motor 28 operably connected to the CAC assembly 12 via a CAC shaft 30. The CAC motor 28 is an electric motor having a rotor 32 rotatably located at the CAC shaft 30. The CAC motor 28 also includes a stator 36 having a plurality of stator windings 38 disposed radially outboard of the rotor 32. The CAC motor 28 also includes one or more bearings 40 disposed at the CAC shaft 30. To prevent overheating of the bearings 40, a bearing cooling flow 42 is supplied via bearing cooling inlet 46 at a first end 48 of the CAC motor 28 opposite a second end 50 at which the CAC assembly 12 is disposed. The bearing cooling flow 42 proceeds across the bearings 40 including thrust bearings 54 located at the first end 48, and across journal bearings 52 located, for example, at the CAC shaft 30 at the first end 48 and/or the second end 50 to remove thermal energy from the bearings 40. The bearing cooling flow 42 exits at a bearing cooling flow exit 56. After passing through the bearing cooling flow exit 56, the bearing cooling flow 42 proceeds substantially radially outwardly into a mixing chamber 58.

In exemplary embodiments, a compressor rotor 62 is operably connected to the CAC shaft 30 and rotates about an axis X as driven by the CAC motor 28. The compressor rotor 62 compresses the air flow 14 to provide a compressed flow 80 in compressor volute 66 of a cabin air compressor housing 68 and directed to a compressor outlet 78. A portion 74 of the air flow 14 may leak past a compressor rotor seal 70 into the mixing chamber 58, where mixing with the bearing cooling flow 42 results in a cooling outlet flow 142. Cooling airflow holes 60 are sized and distributed at an interior portion 72 of the cabin air compressor housing 68 between a journal bearing support 44 and the compressor volute 66 of the cabin air compressor housing 68. The cooling outlet flow 142 is urged outwardly from the mixing chamber 58 through the cooling airflow holes 60 and directed to a cooling flow exit 64.

Figure 2:
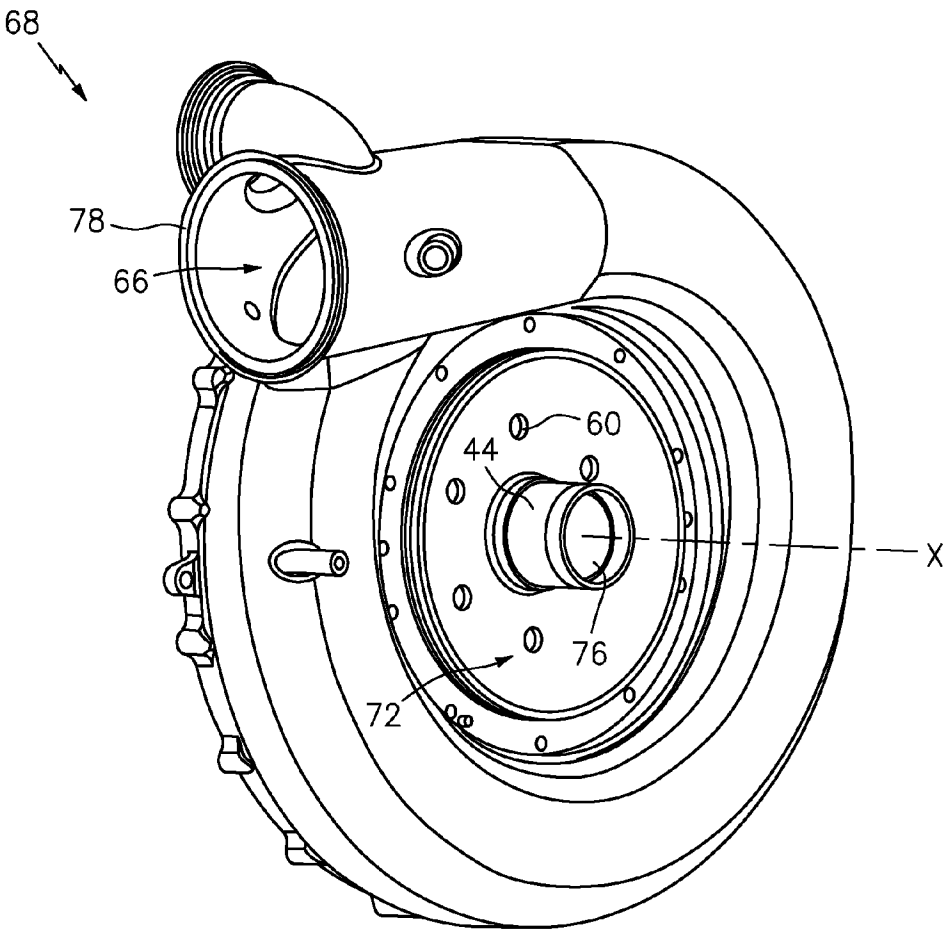
FIG. 2 is a perspective view of a cabin air compressor housing.
Figure 3:
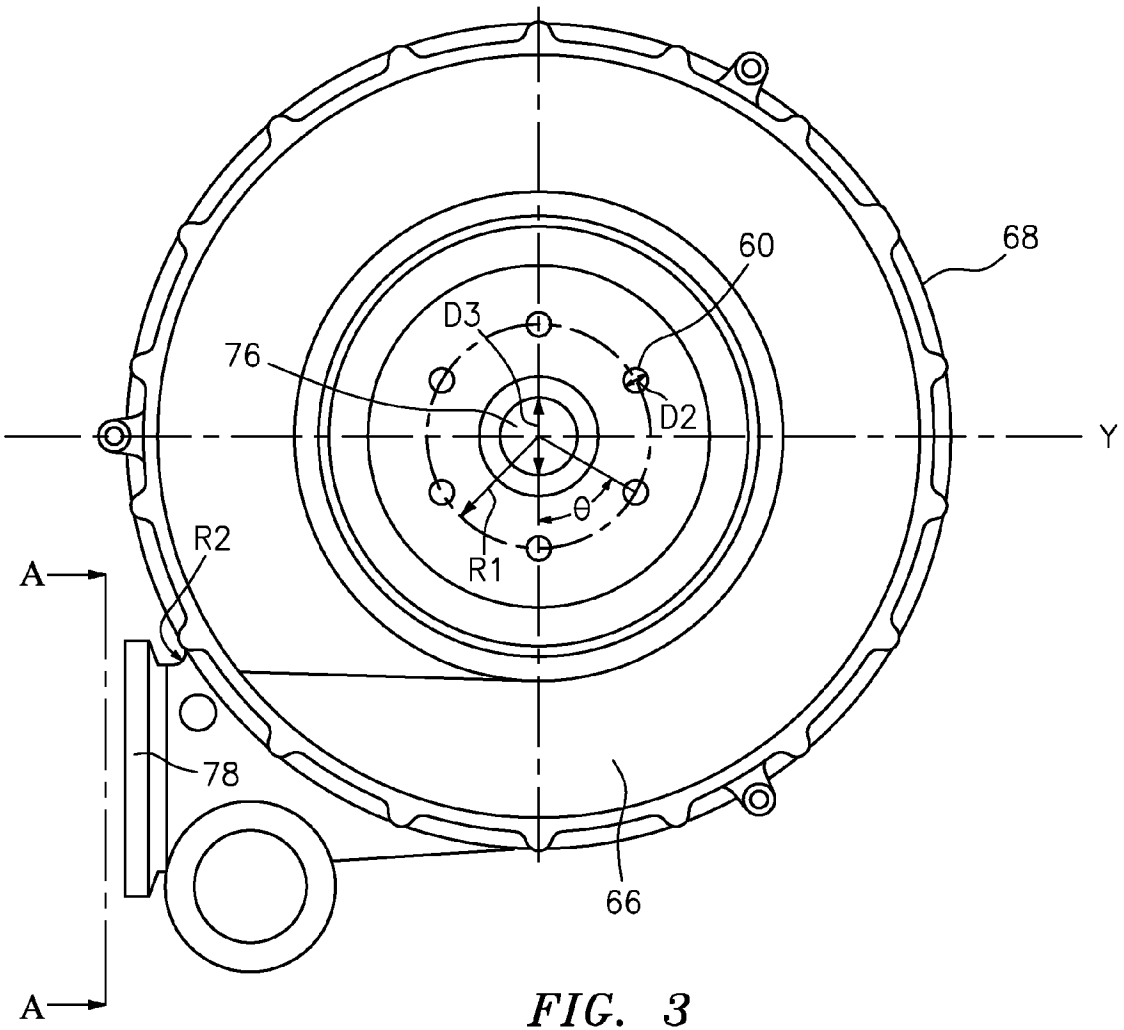
FIG. 3 is a cross-sectional view of the cabin air compressor housing of FIG. 2.

Maintaining an adequate cooling flow for the bearing cooling flow 42 while accounting for the portion 74 of the air flow 14 that leaks past the compressor rotor seal 70 into the mixing chamber 58 to produce the cooling outlet flow 142 may involve a number of features. Referring to FIGS. 1-3, in an embodiment, there are 6 uniformly spaced cooling airflow holes 60 spaced apart at an angle theta of about 60 degrees and positioned at a radius R1 of about 2.6 inches (6.6 cm) from axis X. A diameter D1 of the compressor rotor seal 70 is about 7.79 inches (19.79 cm), a diameter D2 of each cooling airflow hole 60 is about 0.56 inches (1.42 cm), and a diameter D3 of a journal bearing bore 76 of the journal bearing support 44 is about 2.261 inches (5.17 cm). The compressor rotor seal 70 is coupled to the cabin air compressor housing 68 and positioned proximate the compressor rotor 62 in the CAC assembly 12. The journal bearing bore 76 of the journal bearing support 44 is configured to receive one of the journal bearings 52 at the second end 50 of the CAC assembly 12 and direct the bearing cooling flow 42 to the mixing chamber 58.

In an embodiment, a ratio of the diameter D1 of the compressor rotor seal 70 to the diameter D2 of each cooling airflow hole 60 is between 12.56 and 15.59. A ratio of the diameter D3 of the journal bearing bore 76 to the diameter D2 of each cooling airflow hole 60 is between 3.64 and 4.52. A ratio of the radius R1 of the radial position of each cooling airflow hole 60 to the diameter D2 of each cooling airflow hole 60 is between 4.05 and 5.38.

Figure 4:
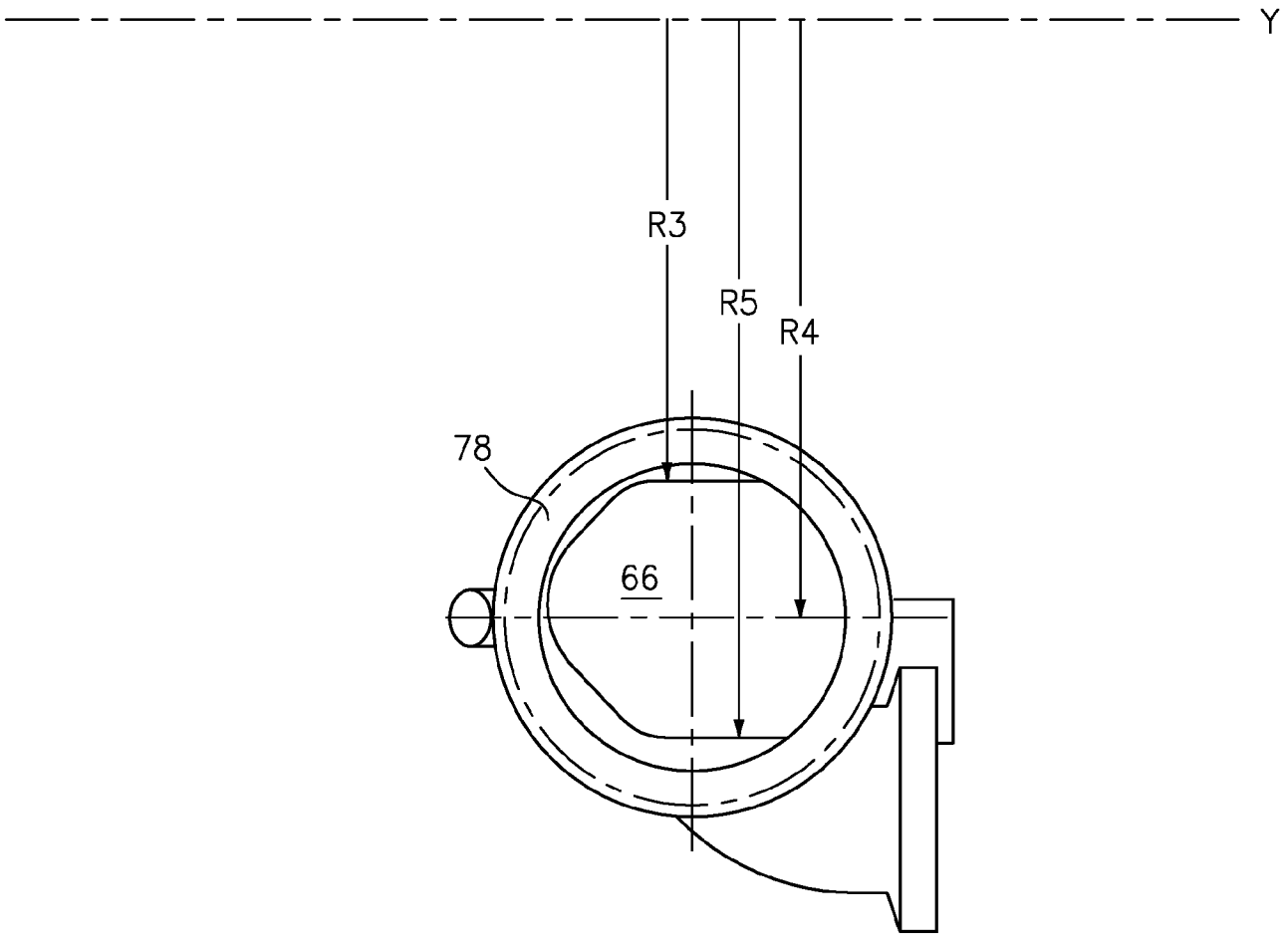
FIG. 4 is a side view of a portion of the cabin air compressor housing of FIG. 3.

Maintaining structural integrity of the compressor volute 66 relative to the compressor outlet 78 of the cabin air compressor housing 68 may involve a number of features. In an embodiment, a fillet radius R2 of about 0.6 inches (1.52 cm) is established between the compressor volute 66 and the compressor outlet 78. A portion of the compressor volute 66 at section A-A of FIG. 3 is depicted in FIG. 4 relative to a transverse axis Y of the cabin air compressor housing 68. In an embodiment, a compressor volute inner radius R3 proximate the compressor outlet 78 is offset about 5.64 inches (14.33 cm) normal to transverse axis Y. A compressor volute center radius R1 proximate the compressor outlet 78 is offset about 7.47 inches (18.97 cm) normal to transverse axis Y. A compressor volute outer radius R5 proximate the compressor outlet 78 is offset about 9.46 inches (20.03 cm) normal to transverse axis Y.

In an embodiment, a ratio of the compressor volute inner radius R3 to the fillet radius R2 is between 8.88 and 9.97. A ratio of the compressor volute center radius R4 to the fillet radius R2 is between 11.78 and 13.19. A ratio of the compressor volute outer radius R5 to the fillet radius R2 is between 14.94 and 16.67.

A process of assembling the CAC assembly 12 can include receiving a journal bearing 52 in the journal bearing bore 76 of the journal bearing support 44 of the cabin air compressor housing 68. The compressor rotor seal 70 is coupled to the cabin air compressor housing 68. The compressor rotor 62 supported by the journal bearing 52 is positioned proximate the interior portion 72 of the cabin air compressor housing 68 to form the mixing chamber 58. The mixing chamber 58 is configured to receive the bearing cooling flow 42 through the journal bearing bore 76 and the portion 74 of air flow that leaks past the compressor rotor seal 70. The interior portion 72 of the cabin air compressor housing 68 establishes the cooling outlet flow 142 from the mixing chamber 58 through the plurality of cooling airflow holes 60. The compressor volute 66 of the cabin air compressor housing 68 is configured to direct a compressed flow 80 produced by the compressor rotor 62 to the compressor outlet 78.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A cabin air compressor housing comprising:

a compressor volute configured to direct a compressed flow to a compressor outlet;

a journal bearing support comprising a journal bearing bore; and an interior portion between the compressor volute and the journal bearing support, the interior portion comprising a plurality of cooling airflow holes having a ratio of a diameter of the journal bearing bore to a diameter of one of the cooling airflow holes between 3.64 and 4.52, wherein the plurality of cooling airflow holes are radially positioned about an axis of the cabin air compressor housing, and a ratio of a radius of the radial position of each of the cooling airflow holes to the diameter of each of the cooling airflow holes is between 4.05 and 5.38, wherein the plurality of cooling airflow holes comprises six cooling airflow holes spaced apart at an angle of 60 degrees.

2. The cabin air compressor housing of claim 1, further comprising:

a fillet radius between the compressor volute and the compressor outlet;

a compressor volute inner radius proximate the compressor outlet;

a compressor volute center radius proximate the compressor outlet; and a compressor volute outer radius proximate the compressor outlet.

3. The cabin air compressor housing of claim 2, wherein a ratio of the compressor volute inner radius to the fillet radius is between 8.88 and 9.97.

4. The cabin air compressor housing of claim 2, wherein a ratio of the compressor volute center radius to the fillet radius is between 11.78 and 13.19.

5. The cabin air compressor housing of claim 2, wherein a ratio of the compressor volute outer radius to the fillet radius is between 14.94 and 16.67.

6. A cabin air compressor assembly comprising:

a compressor rotor operably connected to a shaft;

a plurality of bearings to support rotation of the shaft; and a cabin air compressor housing comprising:

a compressor volute configured to direct a compressed flow produced by the compressor rotor to a compressor outlet;

a journal bearing support comprising a journal bearing bore and configured to receive one of the bearings; and an interior portion between the compressor volute and the journal bearing support, the interior portion comprising a plurality of cooling airflow holes having a ratio of a diameter of the journal bearing bore to a diameter of one of the cooling airflow holes between 3.64 and 4.52, wherein the plurality of cooling airflow holes are radially positioned about an axis of the cabin air compressor housing, and a ratio of a radius of the radial position of each of the cooling airflow holes to the diameter of each of the cooling airflow holes is between 4.05 and 5.38, wherein the plurality of cooling airflow holes comprises six cooling airflow holes spaced apart at an angle of 60 degrees.

7. The cabin air compressor assembly of claim 6, further comprising:

a fillet radius between the compressor volute and the compressor outlet;

a compressor volute inner radius proximate the compressor outlet;

a compressor volute center radius proximate the compressor outlet; and a compressor volute outer radius proximate the compressor outlet.

8. The cabin air compressor assembly of claim 7, wherein a ratio of the compressor volute inner radius to the fillet radius is between 8.88 and 9.97.

9. The cabin air compressor assembly of claim 7, wherein a ratio of the compressor volute center radius to the fillet radius is between 11.78 and 13.19.

10. The cabin air compressor assembly of claim 7, wherein a ratio of the compressor volute outer radius to the fillet radius is between 14.94 and 16.67.

11. The cabin air compressor assembly of claim 6, further comprising:

a compressor rotor seal coupled to the cabin air compressor housing and positioned proximate the compressor rotor, wherein a ratio of a diameter of the compressor rotor seal to the diameter of one of the cooling airflow holes is between 12.56 and 15.59.

12. A method of assembling a cabin air compressor assembly comprising:

receiving a journal bearing in a journal bearing bore of a journal bearing support of a cabin air compressor housing;

coupling a compressor rotor seal to the cabin air compressor housing;

positioning a compressor rotor supported by the journal bearing proximate an interior portion of the cabin air compressor housing to form a mixing chamber, the mixing chamber configured to receive a bearing cooling flow through the journal bearing bore and a portion of air flow that leaks past the compressor rotor seal, the interior portion of the cabin air compressor housing comprising a plurality of cooling airflow holes to establish a cooling outlet flow, the cabin air compressor housing having a ratio of a diameter of the journal bearing bore to a diameter of one of the cooling airflow holes between 3.64 and 4.52 wherein the plurality of cooling airflow holes are radially positioned about an axis of the cabin air compressor housing, and a ratio of a radius of the radial position of each of the cooling airflow holes to the diameter of each of the cooling airflow holes is between 4.05 and 5.38, and the plurality of cooling airflow holes comprises six cooling airflow holes spaced apart at an angle of 60 degrees; and configuring a compressor volute of the cabin air compressor housing to direct a compressed flow produced by the compressor rotor to a compressor outlet, wherein a fillet radius is positioned between the compressor volute and the compressor outlet, a compressor volute inner radius is proximate the compressor outlet, a compressor volute center radius is proximate the compressor outlet, a compressor volute outer radius is proximate the compressor outlet, and a ratio of the compressor volute inner radius to the fillet radius is between 8.88 and 9.97.

13. The method of claim 12, wherein a ratio of the compressor volute center radius to the fillet radius is between 11.78 and 13.19, and a ratio of the compressor volute outer radius to the fillet radius is between 14.94 and 16.67.

14. The method of claim 12, wherein a ratio of a diameter of the compressor rotor seal to the diameter of one of the cooling airflow holes is between 12.56 and 15.59.

* * * * *